US005740914A

United States Patent [19]

Herzog

[11] Patent Number: 5,740,914

[45] Date of Patent: Apr. 21, 1998

[54] CLOSURE FOR STACKING CONTAINERS OF DIFFERENT SIZES

[75] Inventor: James M. Herzog, Lancaster, Ohio

[73] Assignee: Anchor Hocking Packaging Co., Cincinnati, Ohio

[21] Appl. No.: 681,156

[22] Filed: Jul. 22, 1996

[51] Int. Cl.[6] ..... B65D 21/036

[52] U.S. Cl. ..... 206/501; 206/509; 220/608; 220/23.6

[58] Field of Search ..... 206/501, 508, 206/509; 220/212, 23.6, 380, 608, 288

[56] References Cited

U.S. PATENT DOCUMENTS

| | | | |
|---|---|---|---|
| 3,373,896 | 3/1968 | Davis . | |
| 3,749,278 | 7/1973 | Von Boch-Galhau | 206/501 |
| 3,930,589 | 1/1976 | Koontz . | |
| 3,954,178 | 5/1976 | Mason, Jr. . | |
| 4,627,537 | 12/1986 | Rogers . | |
| 4,660,735 | 4/1987 | Peschardt et al. . | |
| 4,711,364 | 12/1987 | Letica . | |
| 4,718,571 | 1/1988 | Bordner . | |
| 4,785,992 | 11/1988 | Goeppner | 206/508 |
| 4,863,030 | 9/1989 | Bayer et al. . | |
| 4,928,839 | 5/1990 | Kruelskie | 206/508 |
| 5,125,538 | 6/1992 | Morris, Sr. . | |
| 5,147,044 | 9/1992 | DiSesa, Jr. | 206/501 |
| 5,344,023 | 9/1994 | Cox et al. | 206/508 |
| 5,409,126 | 4/1995 | De Mars | 206/501 |
| 5,443,853 | 8/1995 | Hayes . | |

*Primary Examiner*—Stephen J. Castellano
*Attorney, Agent, or Firm*—Wood, Herron & Evans, L.L.P.

[57] ABSTRACT

Containers of two different capacities can be stacked on a closure which can be used with either container. The closure has a top panel with an inner stacking area contoured to receive and provide stability to a container having a bottom of one diameter, and an outer stacking area contoured to alternatively receive and provide stability to a larger container having a bottom of a different, larger, diameter.

5 Claims, 2 Drawing Sheets

CLOSURE FOR STACKING CONTAINERS OF DIFFERENT SIZES

FIELD OF THE INVENTION

This invention relates to a container closure on which containers of either of at least two different capacities and two different bottom sizes can be stacked with good stability.

BACKGROUND OF THE INVENTION

A merchant selling food and beverage items packaged in containers frequently desires to stack the containers one upon another in order to conserve shelf space and create an attractive display. This is especially true in the case of foods and beverages for infants, which are usually packaged in small diameter, relatively short containers the individual height of which is much less than the vertical space between shelves in a grocery store. It is desirable to be able to stack such containers, especially if they are made of glass, with reasonable assurance that the stacks will be sufficiently stable as not to topple in ordinary operation. To facilitate such stacking, containers are often provided with a "stacking bead", usually in the form of an annular heel on the bottom, which will seat in a recess on the top of the closure of a similar container below it.

It is also common, particularly in the baby food industry, for a given food product to be packaged in containers of at least two different sizes. Containers are commonly specified in terms of their "finish" size, the finish being the sealing rim and the portion of the container neck on which the threads, lugs or snap rib are formed. In the past, containers of different internal capacities have had different finishes and required different closures. There has been little commonality of closures among the various capacities of containers even though they may contain the same product. For instance, it has been common to package baby food in jars of at least two capacities, a larger jar having a 51 millimeter diameter finish ("51 mm."), as measured at the outside of the helical thread that receives the closure, and in a smaller capacity jar having a 48 millimeter diameter finish ("48 mm."). Because of the different finish sizes, the closure for the larger jar will not seal the smaller jar and vice versa. Furthermore, the larger jar has usually had a larger diameter body and a larger diameter bottom than the smaller jar. The size difference has made a stack of intermixed larger and smaller jars unstable; in the past it has not been safe, for example, to stack a 51 mm jar on a 48 mm jar. This has been a problem for the consumer who desires to stack intermixed larger and smaller jars.

For simplicity of manufacturing and to reduce costs, it is also desirable to have a single common closure size for use with both larger and smaller containers.

One possible approach to resolving those problems might be to use the same size finish, the same size container bottom (and stacking bead), and the same closure configuration for different container sizes. A single closure configuration, adapted to support a single container on it, could then be used. For example, a 48 mm. finish might be used for both larger and smaller capacity containers, with the container stacking beads and the closures for both container capacity sizes being of the size conventionally used in the smaller-capacity (i.e. 48 mm.) containers. However, there is a serious drawback to that approach. Because both the finish and the stacking bead of the larger container would have to be made smaller than usual, that container body would have to be made taller to maintain the same internal capacity. The resulting container, tall and relatively narrow, would then be unstable on high speed conveyor lines. When a container is moved along by conveyor at high speed during packing and sealing at the plant, the acceleration and deceleration of the container incidental to conveying apply turning moments or forces to the container which tend to tip it over. The smaller diameter stacking bead on the bottom of a conventional container with a 48 mm. finish is generally too small to provide adequate base support for a container of larger capacity. Thus, it is not a satisfactory approach to provide commonality of container closures by reforming a larger capacity container to have the body and stacking bead configuration of a conventional 48 mm. finish closure.

An alternative approach, similar to the above, would be to reform the smaller container to cooperate with the wider finish, stacking bead, and closure of the larger container. The problem with this approach is that to maintain the same internal volume, the smaller-capacity jar would then have to be quite short or squat in relation to its diameter. That approach is aesthetically unacceptable.

Another approach might be to provide a finish that is still smaller in diameter, such as a 45 mm. finish, for both sizes of containers, each having its conventional size stacking bead on the bottom. Larger-capacity jars might be stacked on the same closure with the stacking bead overhanging the outer edge of the closure; the smaller-capacity jars with smaller beads could stack on the closure in the conventional manner. However, it has been found that the stability of larger jars stacked in this way is still not adequate. Thus, that also is an unsatisfactory solution to providing a common closure for two different container sizes which can stably support both types of containers on its top.

Therefore, there has been a need for a system whereby containers of two or more different capacities can employ a common closure configuration which is capable of alternatively providing support to both sizes of containers, and whereby the containers still have adequate base support for packing and sealing operations to be carried out without tipping over.

SUMMARY OF THE INVENTION

The present invention overcomes the above noted disadvantages of prior stackable containers and closures. In accordance with the principles of the invention, containers of at least two different capacities are provided with the same size finish but with different stacking bead configurations. A closure is provided having at least two different stacking rings or other regions ("stacking areas") for alternatively receiving the different stacking beads of the respective containers. An outer stacking area on the upper surface of the closure stably receives a larger container stacking bead, while an inner stacking area stably receives a smaller stacking bead. The outer and inner stacking areas may be concentric with one another, but are of different sizes to coact with the different stacking bead sizes.

Each stacking area is a discrete region, preferably an annular ring, on the upper surface of the closure and has an outer wall which slopes downwardly in the radially inward direction (i.e., slopes downwardly toward the center of the closure). Inwardly of the outer wall, each stacking area has a region which is substantially flat, or alternatively a shallow concavity, to support the stacking bead of a container of a first size. The stacking area is sized to receive the stacking bead so that the bead rests within the outer wall which centers it on the closure. The sloping surface of the outer wall resists sideways or lateral movement of the container stacking bead in response to disturbance of the container stacked thereon. Typically, container stacking beads, regardless of size, have a downwardly convex "heel" shape. The outer stacking area may be concave, like a dish, so that the stacking bead will nest in it, although this is not preferred.

The inner stacking area may be similar to the outer stacking area but preferably lies below it (at a lower level) so as not to engage or interfere with the bottom of a larger container stacked on the closure. The angulation of the surface of the closure which lies between the outer stacking area and the inner stacking area is preferably either approximately horizontal or slopes downwardly in the radially inward direction.

The closure according to the present invention can be made in one common size and configuration for application to both larger and smaller capacity containers, both container sizes having the same finish configuration. This eliminates the need for a second set of tooling to make a closure of a second size or configuration. For use with baby food products, the size of the closure is preferably selected to be compatible with the conventional 48 mm. finish configuration. The larger container, although having a smaller finish than conventional for that capacity, still has a lower center of gravity than it would have if its bottom diameter were reduced to fit on a conventional 48 mm. closure. This enhances its stability for packing and sealing purposes.

In principle, a third stacking area of still different radial position or configuration could be provided, if the selected diameter of the finish is large enough.

The present invention thus provides containers of at least two different capacities which can be stacked on a single or common closure, thereby facilitating the stacking of two different sizes of containers intermixed in storage and also reducing closure costs. Moreover, containers configured according to the present invention have good stability for conveying, packing and storing purposes.

The above and other objects and advantages of the present invention shall be made apparent from the accompanying drawings and the description thereof.

DESCRIPTION OF THE DRAWINGS

The accompanying drawings, which are incorporated in and constitute a part of this specification, illustrate a preferred embodiment of the invention and, together with a general description of the invention given above and the detailed description of the embodiment given below, serve to explain the principles of the invention.

DETAILED DESCRIPTION OF THE PREFERRED EMBODIMENT

Figure 1:
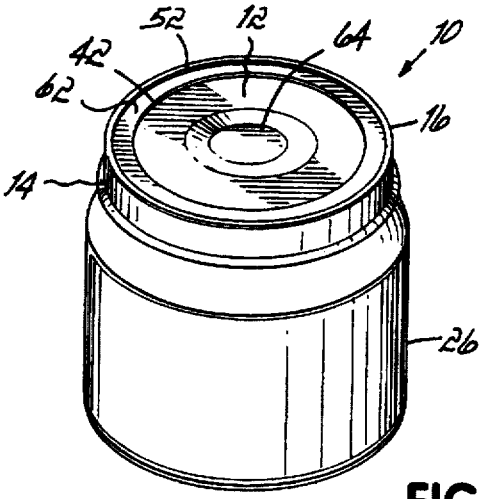
FIG. 1 is a perspective view of a sealed container having a closure according to the present invention.
Figure 3:
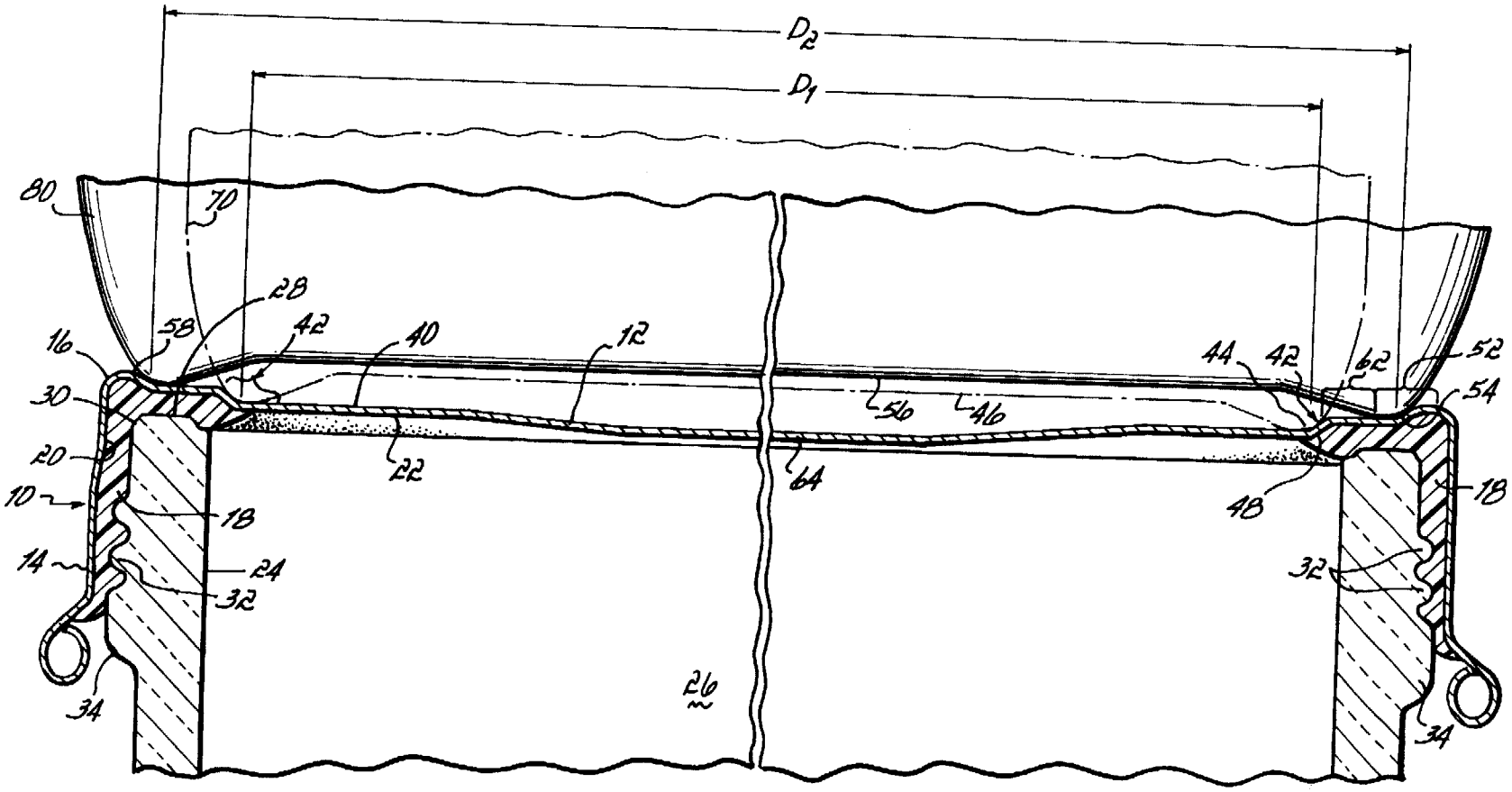
FIG. 3 is an enlarged axial section of a closure according to the present invention taken along line 3—3 of FIG. 2, showing the closure sealed on a container with a larger container of larger bottom diameter resting on the outer stacking area of the closure and, in phantom, the bottom of a smaller container alternatively resting on the inner stacking area of the same closure.

With particular reference to FIGS. 1 and 3, an embodiment of a closure 10 according to the present invention is shown applied to a container. The closure 10 includes a circular top panel 12 and a peripheral skirt 14 that depends from the periphery 16 of the top panel 12. Skirt 14 may have a straight or unconfigured sidewall, as shown on the right side of FIG. 3, or alternatively may have an outward bend, for example as shown on the left side of that figure. The closure may have a plastisol gasket 18 adhered to the inner surface 20 of the skirt 14 and the lower surface 22 of the top panel 12 adjacent its periphery 16. The plastisol may be applied to the closure 10 in an uncured fluid state and then cured to form a suitable gasket 18, for example as described in greater detail in U.S. Pat. No. 4,863,030, issued Sep. 5, 1989, the disclosure of which is incorporated herein by reference.

The closure 10 is sealed against the container rim 28 (which may be of conventional configuration), with the finish 24 pressing into the gasket 18 so that, when compressed between the rim 28 and the top panel 12, the gasket provides an effective seal. The gasket 18 further contacts a first portion 30 of the finish 24 between the rim 28 and the helical thread 32, as well as a second portion 34 below the thread 32. After application of the closure 10 to the container 26, the gasket 18 "cold flows" to conform to the thread 32 so that the closure 10 can be removed from the container 26 by a twisting motion.

The top panel 12 has an upper surface 40 adapted to receive and stably support containers of different capacities with stacking beads of different diameters. To this end, as shown in FIG. 3, the upper surface 40 has an inner stacking area preferably in the form of a ring 42 for providing stability to the "stacking bead" or bottom heel 44 of a container bottom 46 of a first outside diameter $D_1$. The stacking bead 44 may be formed in conformity with standard GCI C-700 specification. Because the container stacking bead 44 conventionally has a convex shape (bulged downward as shown), the angulated outer wall 48 of inner ring 42 has a downward and inward (negative or "dished") curvature. By reason of the dish-like curvature of the outer wall 48 of inner ring 42, the ring 42 cradles or nests the container stacking bead 44 and restrains movement of the container bottom laterally on the upper surface 40 in response to a sideways force on the container. Inwardly of inner ring 42, the closure preferably does not project upwardly, at least does not project upwardly so far as to impede the container bottom above it.

The upper closure surface 40 further has an outer stacking area or ring 52 for providing stability to the stacking bead 54 of a container bottom 56 of a larger second outside diameter $D_2$. The outer area 52 likewise preferably has a dish-like angulated outer wall 58 to cradle the bead 54. Preferably the outer ring 52 lies over the rim 28 of the container sealed by the closure and the inner ring 42 lies inward of the rim. The top panel preferably slants downward and inward over the inner edge of container 28, to "pinch" the gasket in sealing. The inner stacking area preferably lines over the mouth area of the container, somewhat inward of the container inner rim.

In order that the inner stacking area 42 not interfere with the container bottom 56 of a larger container stacked on the upper surface 40, it is preferably set below the outer area 52. The inner and outer stacking areas 42 and 52 are spaced apart by an intermediate annular region 62. This area 62 preferably does not have a positive slope (positive slope being defined as an upward slope in the radially inward direction, and negative slope being a downward slope in the radially inward direction), but rather is either horizontal or has slight negative slope as shown.

Although the inner and outer stacking areas are preferably continuous ring or band-like areas as shown in FIG. 1, they could alternatively be discontinuous or interrupted. For example, each stacking area could be a plurality of discrete spaced apart segments. Such segments may be arcuate with a dish-like section as described in connection with areas 42 and 52. Still another alternative is to make the stacking areas continuous but not circular. For instance, each stacking area could be polygonal or irregularly formed, especially if the container bottom has corresponding portions to be seated in the stacking areas. From the description given above, other modifications of the stacking areas, within the scope of the invention, may occur to persons of ordinary skill in the art.

The closure 10 preferably is formed from a single piece of sheet metal in the conventional manner, for example of 55 lb. double reduced plate. As shown in FIG. 1, the closure preferably incorporate a vacuum-indicating button 64 in the top panel 12. The button 64 is drawn inward toward the contents of the container when the inside of the container is under vacuum. If vacuum is lost, the button 64 audibly pops up to provide both aural and visual indications that the vacuum seal has been breached.

Figure 2:
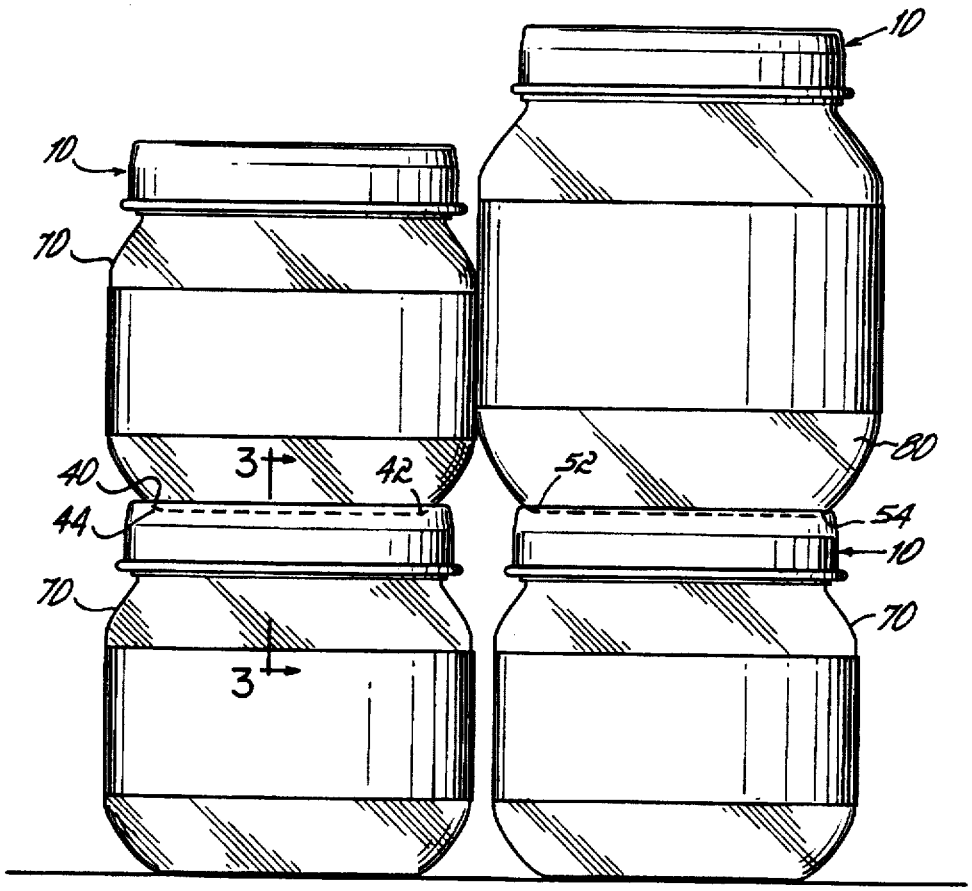
FIG. 2 is a side elevation of several containers of two different sizes, all having closures according to the present invention, stacked one upon another.

The "double stacking" capability of the new closure is depicted in FIG. 2. The closure 10 stably supports a smaller container 70, with the inner stacking area 42 nestingly receiving and cradling the stacking bead 44 of that container. Alternatively, the same closure 10 can stably support a larger container 80 having its larger-diameter stacking bead 54 nested in the outer stacking area 52. The finishes on containers 70 and 80 may be substantially identical to one another, and the closures on containers 70 and 80 may be substantially identical, as in FIG. 2, so that the same closure may be used on either container. The commonality of closures enables the larger 80 to be stacked on the smaller container 70 and vice versa, thereby permitting the consumer or other user to intermix the containers 70 and 80 in a stack if so desired. The finish size on the larger container 80 is smaller than conventionally used on containers of that same capacity, being of a size more typically used on the smaller container 70. For instance, the finish diameter of a container having the capacity of a 51 mm conventional container (measured at the outside of the thread) is preferably 48 millimeters, rather than the conventional 51 mm finish. The smaller than usual finish results in a lower center of gravity for the larger container 80, which enhances the stability of the container during high-speed packing and sealing operations. However, it should be noted that, while the container finishes are the same configuration, the containers have different stacker beads, each preferably being the bead conventional for a container of that respective capacity.

Although the invention has been illustrated by a description of a press-on, twist-off closure, the invention is also applicable to other types of closures as well, such as snap-on closures that are removed by prying, twist-on closures that engage lugs on the container finish, and on closures having a single continuous thread ("CT"). Likewise, while the embodiment illustrated and described is a one-piece metal closure, the invention can also be used in all plastic closures and in composite closures having a separately formed top panel housed in a shell or skirt. The invention is applicable to container closures having an upper surface large enough to support a container bottom so long as the container bottom and the closure upper surface are of non-interfering shapes.

Therefore, while the present invention has been illustrated by a description of a specific embodiment and while this embodiment has been described in considerable detail, it is not the intention of the applicant to restrict or in any way limit the scope of the appended claims to such detail. Furthermore, from the disclosure additional advantages and modifications will appear to those skilled in the art. The invention in its broader aspects is therefore not limited to the specific details, representative apparatus and method, and illustrative example shown and described. Accordingly, departures may be made from such details without departing from the spirit or scope of applicant's general inventive concept.

What is claimed is:

1. A closure and at least two containers of different internal capacities, each container having a finish for receiving the closure and a stacking bead for stacking that container on the closure, the finishes of the containers being of the same size, said containers comprising a first container of a first internal capacity and a stacking bead of a first diameter, and a second container of a different internal capacity and a stacking bead of a second diameter smaller than that of said first container, said closure being configured for use with each said container and comprising a top panel and a skirt depending from said top panel, said skirt adapted to surround and grip the finish of each container alternatively, said top panel having an outer stacking area contoured to nestingly receive the stacking bead of said first container if placed on said closure, said top panel having an inner stacking area inwardly of said outer stacking area, said inner area being contoured to nestingly receive the stacking bead of said second container if placed on said closure, said closure having a sealing gasket on an under-surface thereof, said outer stacking area being above said sealing gasket, and said inner stacking area being positioned to lie above the mouth opening of a container to which said closure has been applied.

2. The closure and containers of claim 1 wherein each of said outer and inner stacking areas includes an outer wall having a negative slope in the inward radial direction.

3. The closure and containers of claim 1 wherein said top panel has an intermediate area between said outer area and said inner area, said intermediate area having a slope less than or equal to approximately zero.

4. The closure and containers of claim 1 wherein each of said outer and inner stacking areas is an annular ring.

5. The closure and containers of claim 1 wherein said inner stacking area lies below said outer stacking area.

* * * * *